US007677535B1

(12) United States Patent
Lo

(10) Patent No.: US 7,677,535 B1
(45) Date of Patent: Mar. 16, 2010

(54) RAILING

(76) Inventor: Chong-Yi Lo, 3500, Valley Meadow Rd., Sherman Oaks, CA (US) 91403

( * ) Notice: Subject to any disclaimer, the term of this patent is extended or adjusted under 35 U.S.C. 154(b) by 11 days.

(21) Appl. No.: 12/232,360

(22) Filed: Sep. 16, 2008

(51) Int. Cl.
*E04H 17/00* (2006.01)

(52) U.S. Cl. ..... 256/65.08; 256/22; 256/59; 256/65.01; 256/65.12; 256/69

(58) Field of Classification Search ..... 256/19, 256/21, 22, 59, 65.01, 65.02, 65.03, 65.08, 256/65.12, 69
See application file for complete search history.

(56) References Cited

U.S. PATENT DOCUMENTS 3,414,236 A * 12/1968 Siegal ..... 256/22
3,463,456 A * 8/1969 Walker ..... 256/22
4,390,165 A * 6/1983 Murdock ..... 256/24
4,809,955 A * 3/1989 Veilleux ..... 256/65.02
5,288,058 A * 2/1994 Russell ..... 256/69
5,404,682 A * 4/1995 West ..... 52/165
5,649,688 A * 7/1997 Baker ..... 256/21
6,752,385 B2 * 6/2004 Zen et al. ..... 256/65.01
6,932,329 B1 * 8/2005 Harder ..... 256/67
7,032,890 B2 * 4/2006 Svalbe ..... 256/21
7,347,412 B1 * 3/2008 Zhu ..... 256/22
7,384,025 B2 * 6/2008 Lo ..... 256/65.08

* cited by examiner

*Primary Examiner*—Michael P. Ferguson
*Assistant Examiner*—Nahid Amiri
(74) *Attorney, Agent, or Firm*—Bacon & Thomas PLLC

(57) ABSTRACT

A railing has its posts and rails intersected with each other and fixed stably together by connecting plates hidden inside the rails. The connecting plate has a wing formed at a preset position between every two posts. The wing has a hole at its center. Each of the rails has a long space defined by three walls of its inverted U-shape, a rectangular opening bored in its top side for being correspondingly inserted by the post, and a female-threaded tube extended downward from an upper inner wall for corresponding to a hole of a wing of the connecting plate so that a screw can be inserted from under the hole to threadably engage with the female-threaded tube to keep the rails fixed with the connecting plates. The railing is thus assembled stably by means of the connecting plates and the screws that are hidden inside the rails, obtaining an aesthetic appearance.

2 Claims, 5 Drawing Sheets

RAILING

BACKGROUND OF THE INVENTION

1. Field of the Invention

This invention relates to a railing, particularly to one having connecting plates and screws used to fix the posts with the rails invisibly hidden inside the rails.

2. Description of the Prior Art

Commonly, a conventional fence made of metal is formed by intersection of plural posts and rails. Each intersection of the rails and the posts is fastened by a screw. However, the head of the screw is always exposed out of the rails, making the fence look ugly.

SUMMARY OF THE INVENTION

The objective of this invention is to offer a railing formed by intersection of plural posts and rails stably fixed by connecting plates and screws that are invisibly hidden inside the rails, so as to enable the railing to maintain an esthetic appearance.

The connecting plates are transversely fixed with the posts at the intersections of the posts and the rails, respectively provided with a wing to protrude sidewise between every two posts. The wing is bored with a hole at its center. Each of the rails is provided with a long space defined by three walls of its inverted U-shape, and a rectangular opening bored in its top side for being correspondingly inserted by the post. The rails are to be laid on a top of the connecting plates, also respectively provided with a female-threaded tube extended downward from an inner wall of its top side for corresponding to a hole of a wing of the connecting plate so that a screw can be inserted from the bottom of the hole to threadably engage with the female-threaded tube to keep the rails fixed with the connecting plates. With the connecting plates and the screws hidden inside the rails to keep the posts and the rails stably fixed, an esthetic appearance of the railing can be obtained.

BRIEF DESCRIPTION OF DRAWINGS

This invention is better understood by referring to the accompanying drawings, wherein.

DETAILED DESCRIPTION OF THE PREFERRED EMBODIMENT

Figure 1:
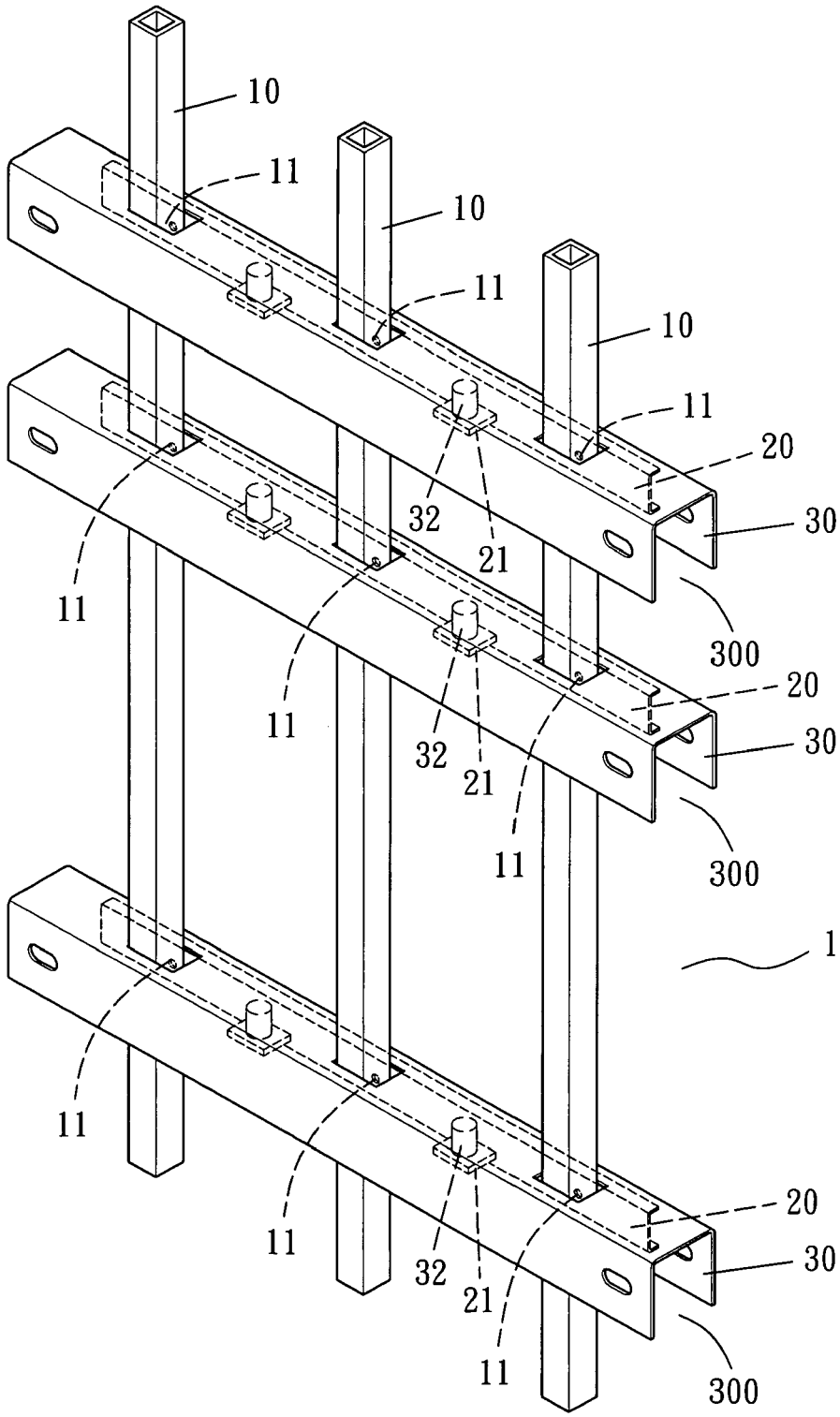
FIG. 1 is a perspective view of a preferred embodiment of a railing in the present invention.
Figure 2:
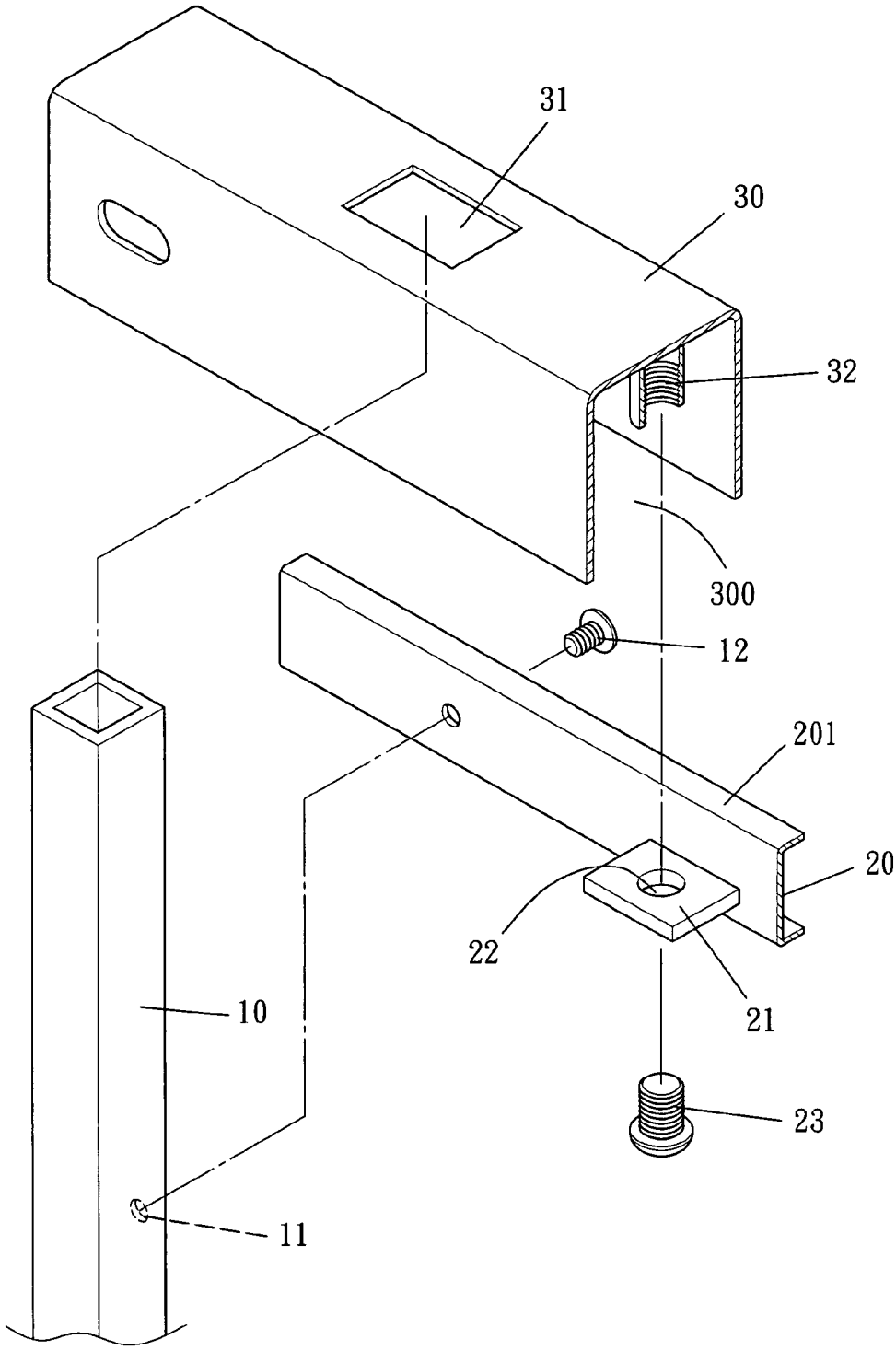
FIG. 2 is a partial exploded perspective view of the preferred embodiment of a railing in the present invention.
Figure 3:
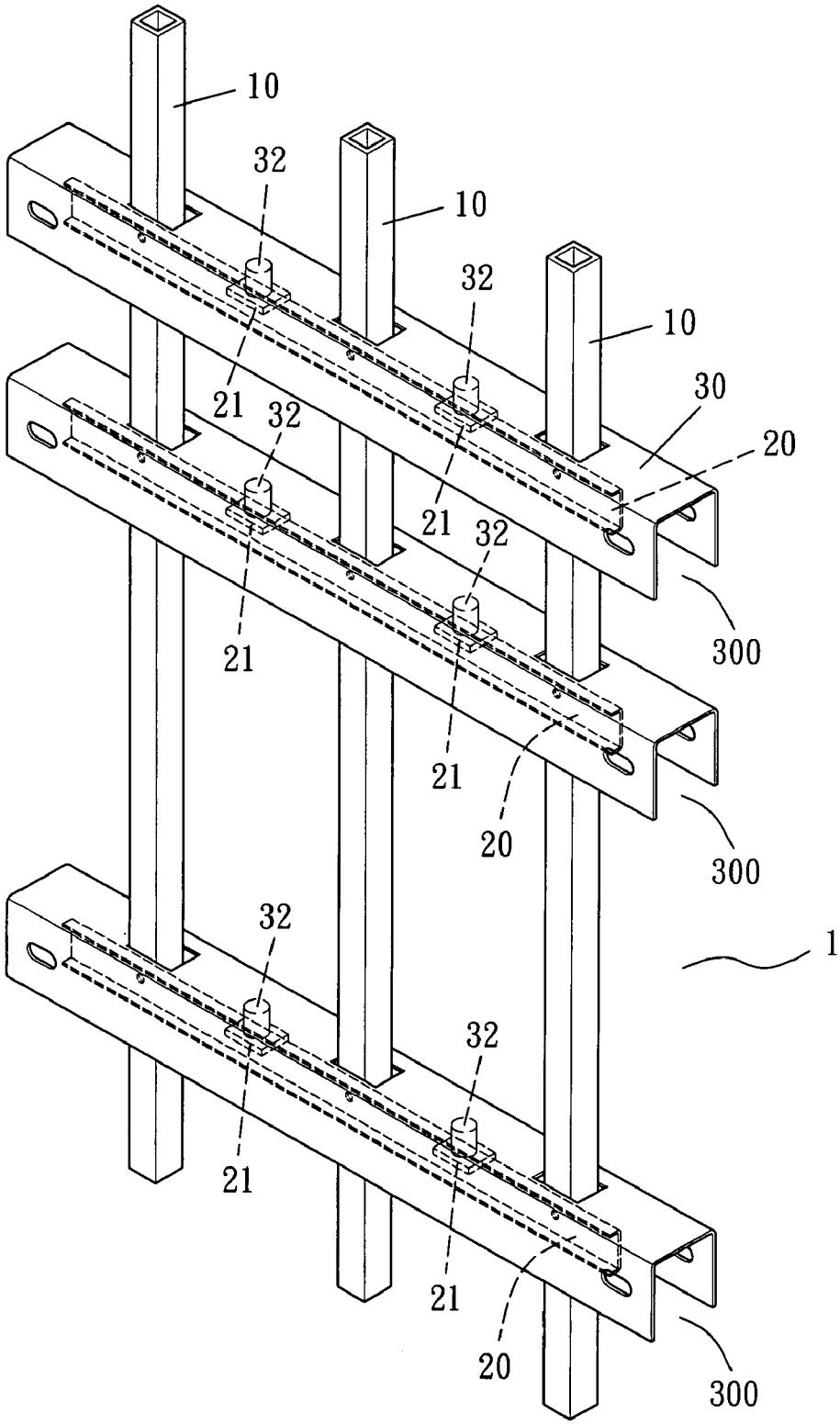
FIG. 3 is another perspective view of the preferred embodiment of a railing in the present invention.

As shown in FIGS. 1~3, a preferred embodiment of a railing 1 in the present invention is provided with plural posts 10 and plural rails 30, which are intersected with each other, and plural connecting plates 20.

The posts 10 are formed square, respectively provided with plural threaded holes 11 bored properly spaced apart in their outer wall to be jointed with the rails 30.

The connecting plates 20 are needed as many as the rails 30, respectively and transversely fixed at one side of the posts 10 by means of screws 12 screwed in the threaded holes 11 of the posts 10, so that the posts 10 are connected to stand side by side. Each of the connecting plates 20 is provided with a horizontal low contact wall 201 formed by having its top portion vertically bent, and a horizontal wing 21 formed to protrude sidewise between every two posts 10. The wing 21 is bored with a hole 22 at its center.

Each of the rails 30 is shaped as an inverted U, forming a long space 300 among its three walls, having a rectangular opening 31 bored in its top side for being correspondingly inserted by the post 10 entering from the space 300. When the rail 30 is laid down on the connecting plates 20, the inner wall of its top side is to automatically contact with the contact wall 201 of the connecting plate 20, with the connecting plate 20 hidden inside the rail 30. In addition, the rail 30 is also provided with a female-threaded short tube 32 extended downward from the inner wall of its top side in corresponding to the hole 22 of the wing 21 of the connecting plate 20, so that a screw 23 can be inserted from under the hole 22 of the wing 21 to threadably engage with the female-threaded tube 32 of the rail 30 to keep the rail 30 fixed stably with the connecting plate 20.

Figure 4:
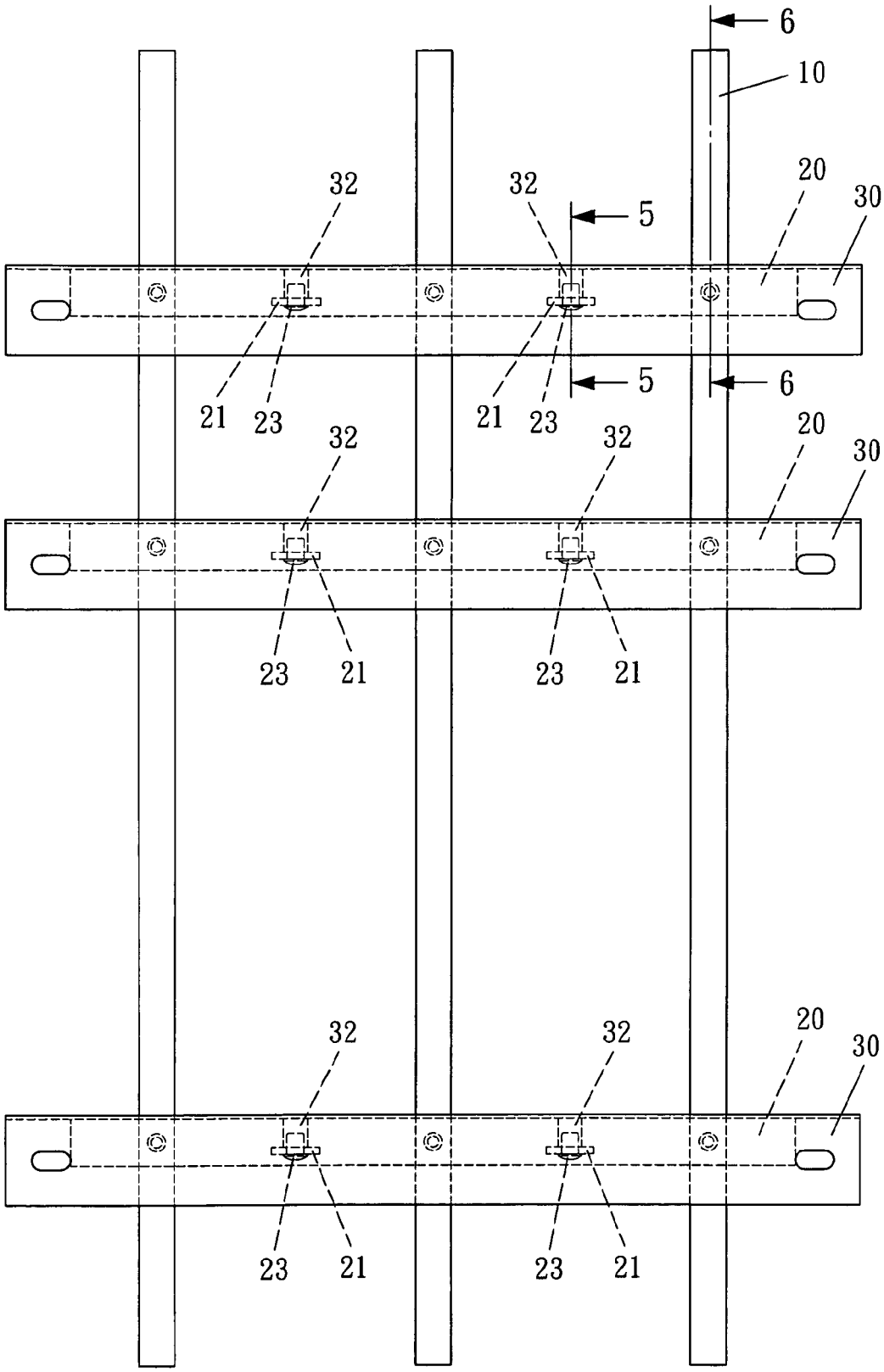
FIG. 4 is a front view of the preferred embodiment of a railing in the present invention.
Figure 5:
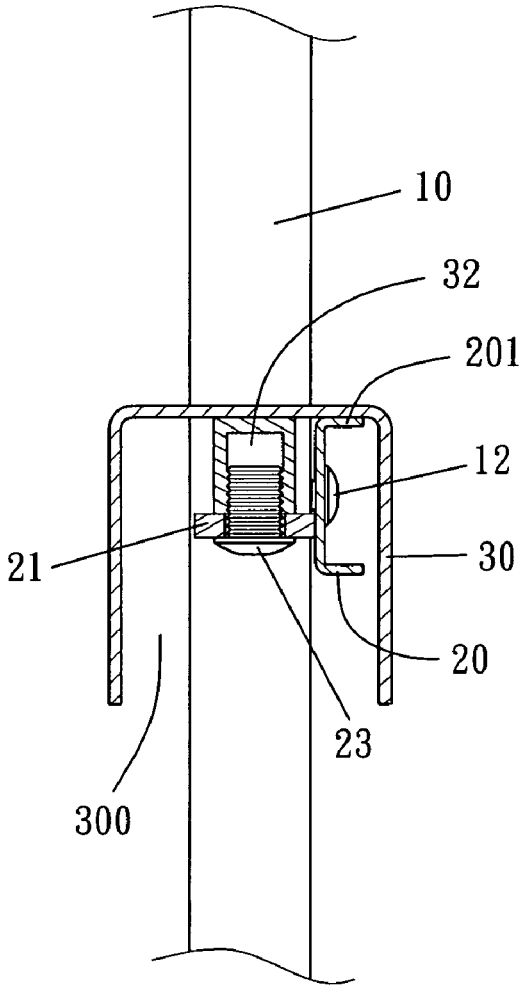
FIG. 5 is a cross-sectional view of the line of "5-5" in FIG. 4.
Figure 6:
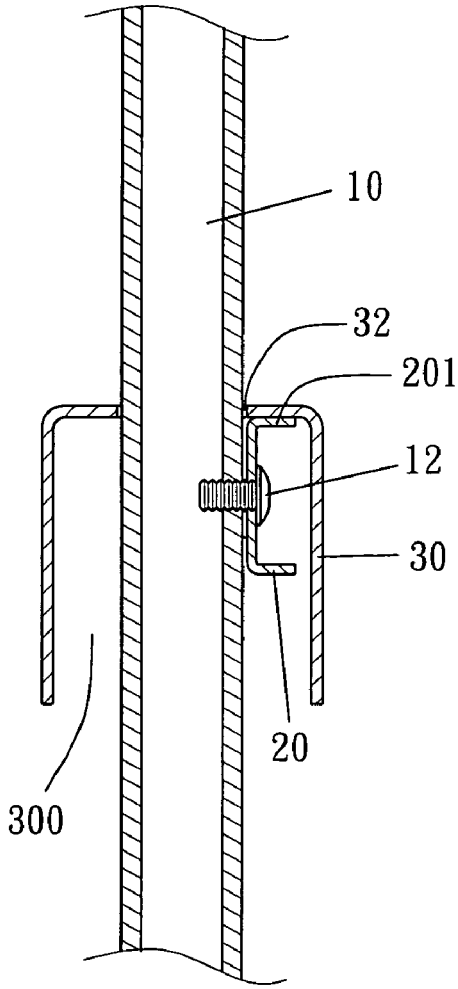
FIG. 6 is a cross-sectional view of the line of "6-6" in FIG. 4.

In assembling the railing 1, as shown in FIGS. 4~6, the connecting plate 20 is first fixed with posts 10 at the lowest fixing position. Next, the rail 30 is inserted from the top of the posts 10 through the openings 31 to rest on the contact wall 201 of the connecting plate 20, and each of the female-threaded tubes 32 of the rail 30 is threadably engaged with the screw 23 inserted from under the hole 22 of the wing 21 so as to keep the rail 30 fixed with the connecting plate 20. According to the process described above, all the posts 10 can be fixed with all rails 30 orderly leveled up, thus finishing assembly of the railing 1. With the rails 30 fixed with the connecting plates 20 by means of the screws 23 threadably engaged with the threaded holes 32 as mentioned previously, the rails 30 can be firmly fixed with the posts 10 without moving upward. Moreover, the connecting plates 20, including the wings 21 and the screws 12 and 23, are all hidden inside the rails 30 so that the railing 1 can completely maintain an esthetic appearance.

As the openings 31 of the rails 30 are formed rectangular as shown in FIG. 2, they can be vertically passed by the posts 10 even if the rails 30 are inclined owing to an inclined ground. So, the railing 1 can be installed on an inclined ground as well.

While the preferred embodiment of the invention has been described above, it will be recognized and understood that various modifications may be made therein and the appended claims are intended to cover all such modifications that may fall within the spirit and scope of the invention.

What is claimed is:

1. A railing, comprising:

plural pickets and rails that are fixedly intersected with each other by means of plural connecting plates, wherein said connecting plates correspond in number to said rails and are respectively and transversely fixed at one side of said pickets by means of plural screws to keep said pickets connected to stand side by side, a horizontal wing formed to protrude sidewise from an intermediate portion of each of said connecting plates between every two said pickets and bored with a hole at its center; and each one of said rails provided with a long space defined by three walls in an inverted U-shape, an opening bored in a top side of each one of said rails for corresponding to each said picket passing through each one of said rails, one of said connecting plates hidden inside each one of said rails, a female-threaded tube extended downward from an inner wall of a top side each one of said rails for corresponding to said hole of each said wing of a respective one of said connecting plates so that a screw is inserted from under said hole of said wing to threadably engage with said female-threaded tube of one of said rails to keep each one of said rails fixed with said connecting plate, wherein each of said connecting plates is provided with a horizontal contact short wall formed at its top to contact with a vertical inner wall of a top side of each one of said rails.

2. The railing as claimed in claim 1, wherein said opening of said rails is formed rectangular, and said pickets are formed square and able to pass through said opening of said rails.

* * * * *